US005607771A

United States Patent [19]

Matsuse et al.

[11] Patent Number: 5,607,771

[45] Date of Patent: Mar. 4, 1997

[54] THERMAL TRANSFER RECORDING MEDIUM

[75] Inventors: Takashi Matsuse; Hideki Yanagi; Hiroyuki Mitobe; Masafumi Miyamoto; Masayoshi Nawa, all of Tochigi-ken, Japan

[73] Assignee: Kao Corporation, Tokyo, Japan

[21] Appl. No.: 450,858

[22] Filed: May 25, 1995

[30] Foreign Application Priority Data

Jun. 10, 1994 [JP] Japan ..... 6-129349
Dec. 8, 1994 [JP] Japan ..... 6-305163

[51] Int. Cl.[6] ..... B41M 5/26

[52] U.S. Cl. ..... 428/423.1; 428/195; 428/522; 428/913; 428/914

[58] Field of Search ..... 428/195, 484, 428/488.1, 488.4, 913, 914, 423.1, 522

[56] References Cited

U.S. PATENT DOCUMENTS 5,268,052 12/1993 Takizawa et al. ..... 156/234
5,290,623 3/1994 Kawahito et al. ..... 428/195

FOREIGN PATENT DOCUMENTS 0339353 11/1989 European Pat. Off. .
0357363 3/1990 European Pat. Off. .
0420132 4/1991 European Pat. Off. .
0444641 9/1991 European Pat. Off. .
4141017 6/1992 Germany .

*Primary Examiner*—Bruce H. Hess
*Attorney, Agent, or Firm*—Oblon, Spivak, McClelland, Maier & Neustadt, P.C.

[57] ABSTRACT

Disclosed is a thermal transfer recording medium comprising a substrate provided thereon at least an ink layer which is to be transferred by heat application, characterized in that the loss tangent (tan δ) of the ink layer in viscoelasticity measurement at a temperature of from 60° to 100° C. ranges from 0.4 to 2.5.

10 Claims, No Drawings

THERMAL TRANSFER RECORDING MEDIUM

BACKGROUND OF THE INVENTION

This invention relates to a thermal transfer recording medium and particularly to a hot-melt thermal transfer recording medium exhibiting high sensitivity and excellent performance in recording on an image-receiving element having a flat and smooth surface. The thermal transfer recording medium of the present invention is particularly useful for recording on a flat and smooth image-receiving element to produce a negative mask for image formation.

As is well known, hot-melt thermal transfer recording process is a recording system in which a thermal transfer recording medium comprising a substrate in sheet form coated thereon at least one hot melt ink layer is superposed on an image-receiving element with its hot melt ink layer contacting with the image-receiving element, and the hot melt ink layer is imagewise melted by the action of heat from the substrate side by means of a thermal printing head and transferred onto the image-receiving element to give a transferred image. This recording system has recently been widespread because of its utility in printing units featuring small size, lightness, competitive price and easy handling.

One of the characteristics of the hot-melt thermal transfer recording system is high freedom of choice in the kind of image-receiving elements to which it is applicable. That is, recording or printing can be conducted on not only common paper but fabric, plastic sheets or films, etc. In particular, with the recent spread of overhead projectors (OHP), occasion to record information on a transparent image-receiving element, such as a flat, smooth and transparent plastic sheet or film, has been increasing, and accordingly, the need for thermal transfer recording on such a transparent image-receiving element has been increasing.

However, when a conventional thermal transfer recording medium is used in printing on a flat, smooth and transparent image-receiving element, such as an OHP sheet, the resulting image suffers from blur, loss of definition, thickening of letters, or the tail of the printed image with reference to the recording direction and has disturbed or unprinted portions. These image defects are considered to be ascribed mainly to running or stringing of the ink at the time of ink transfer.

In order to overcome the above problem, it has been proposed to provide an ink-receiving layer on the surface of an image receiving element as disclosed in Japanese Patent Laid-Opens 61-135791 and 1-45688. However, the proposal is not feasible for practice because the ink-receiving layer not only incurs an increase of cost but reduces transparency of the image-receiving element, resulting in reduction in contrast between image areas and non-image areas (background).

On the other hand, it is known that a negative mask for image formation can be prepared by directly printing a negative image on a transparent material by making use of the hot-melt thermal transfer recording system. According to this method, no post treatment is required, and a mask can easily be obtained by means of general purpose type business machine adopting a thermal transfer recording system, such as a word processor or a printer.

Nevertheless, conventional thermal transfer recording media could not provide a negative image having a transmission density of at least 1.5 as is required for serving as a mask.

In order to solve the above problem, multiple printing or increase of the amount of the ink transferred has been attempted. In these cases, however, the resulting negative image has a reduced resolving power, and a mask with satisfactory image quality cannot be obtained.

SUMMARY OF THE INVENTION

An object of the present invention is to provide a thermal transfer recording medium enabling clear and economical recording on a flat and smooth image-receiving element with high sensitivity.

Another object of the present invention is to provide a thermal transfer recording medium which can be used in direct printing on a flat, smooth and transparent image-receiving element to prepare a negative mask for image formation.

A still another object of the present invention is to provide a negative mask for image formation which has a high resolving power and a high contrast.

As a result of extensive investigations, the present inventors have found that a thermal transfer recording medium whose ink layer has a loss tangent (tan δ) in viscoelasticity measurement in a specific temperature range falling within a prescribed range does not cause running or stringing of the ink at the time of ink transfer even when applied onto a flat and smooth image-receiving element having been subjected to no surface treatment and provides a recorded (or printed) image with reduced defects such as blur, loss of definition, thickening of letters and disturbance or occurrence of unprinted portions in the tail of the printed image, and also with uniformity and high density in the printed areas.

The present invention has been completed based on this finding. The present invention provides a thermal transfer recording medium comprising a substrate provided thereon at least an ink layer which is to be transferred by heat application, characterized in that the loss tangent (tan δ) of the ink layer in viscoelasticity measurement at a temperature of from 60° to 100° C. ranges from 0.4 to 2.5.

The thermal transfer recording medium of the present invention is particularly suited to recording on a flat, smooth and transparent image-receiving element by a hot-melt thermal transfer recording system to provide a negative mask for image formation.

DETAILED DESCRIPTION OF THE INVENTION

In the thermal transfer recording medium according to the present invention, the loss tangent (tan δ) of the ink layer as obtained by measuring viscoelasticity at a temperature of from 60° to 100° C. ranges from 0.4 to 2.5, preferably 0.4 to 2.0. If tan δ is higher than 2.5, the ink layer undergoes running or stringing to impair recording characteristics. If tan δ is lower than 0.4, the ink layer exhibits too high elasticity to undergo cohesive failure while being transferred. It follows that the ink layer is not smoothly released from the substrate, failing to achieve satisfactory recording. The method for measuring the value of tan δ will be described later.

The ink layer essentially comprises a binder resin and a colorant and is so adjusted as to have tan δ ranging from 0.4 to 2.5 as measured at a temperature of from 60° to 100° C. The adjustment of tan δ may be made by proper choice of the kinds of binder resins and colorants and also by appropriate addition of a viscoelasticity modifier, such as waxes and tackifiers, as hereinafter described.

Binder resins to be used are not particularly limited as far as the tan δ of the resulting ink layer may range from 0.4 to 2.5. Examples of usable binder resins include polyester resins, polyether resins, polyamide resins, polystyrene resins, ethylene-vinyl acetate copolymers, vinyl chloride-vinyl acetate copolymers and an isocyanate adduct of higher fatty acid polyhydric alcohol esters. These binder resins may be used either individually or as a combination of two or more thereof. The binder resin is usually used in an amount of 10 to 90 parts by weight based on 100 parts by weight of an ink layer. A preferred range of the amount of the binder resin to be used depends on the kind as hereinafter described.

In a first preferred embodiment of the present invention, the binder resin comprises a first binder resin which is at least one resin selected from the group consisting of a polystyrene resin, an ethylene-vinyl acetate copolymer, a vinyl chloride-vinyl acetate copolymer and an ethylene-acrylate copolymer, and a second binder resin which is at least one resin selected from the group consisting of a polyester resin, a polyether resin, a polyamide resin and an isocyanate adduct of a higher fatty acid polyhydric alcohol ester.

The polystyrene resin includes both a homopolymer of styrene and a copolymer of styrene and a comonomer (e.g., a diene monomer), the proportion of the comonomer being within such that may which is present therein and whose proportion is of an extent that the comonomer does not impair the properties inherent to polystyrene resins. A styrene-butadiene copolymer may be mentioned as a preferred example of the polystyrene resins.

The ethylene-vinyl acetate copolymer is a copolymer obtained by copolymerization of ethylene and vinyl acetate. While not limited, the ratio of ethylene to vinyl acetate in the copolymer is preferably 15:85 to 85:15 by weight.

The vinyl chloride-vinyl acetate copolymer is a copolymer obtained by copolymerization of vinyl chloride and vinyl acetate. While not limited, the ratio of vinyl chloride to vinyl acetate in the copolymer is preferably 20:80 to 80:20 by weight.

The ethylene-acrylate copolymer is a copolymer obtained by copolymerization of ethylene and an acrylate (e.g., methyl methacrylate). The acrylate may be a single compound or a mixture of two or more acrylates. While not limited, the ethylene to acrylate ratio in the copolymer is preferably 80:20 to 20:80 by weight.

The polyester resin includes, for example, fatty acid polyesters but is not limited thereto. Preferred polyester resins are those obtained by polycondensation of bisphenol A (i.e., 4,4'-dihydroxydiphenylpropane) and a straight-chain aliphatic dicarboxylic acid.

The polyether resin includes, for example, aromatic polyethers but is not limited thereto. Preferred polyether resins are bisphenol type aromatic polyethers.

The polyamide resin includes, for example, fatty acid polyamides but is not limited thereto.

The isocyanate adduct of a higher fatty acid polyhydric alcohol ester is obtained by addition reaction of an isocyanate compound to an ester of a higher fatty acid and a polyhydric alcohol. The isocyanate compound includes trilene diisocyanate. While the number of moles of the isocyanate compound to be added is not particularly restricted, it is preferably about 0.1 to 5 moles based on mole of the ester.

Of various combinations of a first binder resin and a second binder resin, preferred are a combination of an ethylene-vinyl acetate copolymer and a polyether resin and a combination of an ethylene-vinyl acetate copolymer and an isocyanate adduct of a higher fatty acid polyhydric alcohol ester. A combination of an ethylene-vinyl acetate copolymer and the isocyanate adduct is particularly preferred.

The weight ratio a/b of the first binder resin a to the second binder resin b is preferably from 0.1 to 10, still preferably from 0.15 to 7. If the weight ratio a/b is less than 0.1, the ink layer tends to have insufficient adhesion to the substrate or a image-receiving element. If it exceeds 10, the ink layer tends to be too sticky to be smoothly released from the substrate on thermal transfer.

The total amount of the first binder resin a and the second binder resin b is preferably 30 to 70 parts by weight, still preferably 40 to 70 parts by weight, based on 100 parts by weight of the ink layer. If it is less than 30 parts by weight, the adhesion of the ink layer to the substrate tends to be insufficient, and the fixability of the transferred ink tends to be insufficient for practical use. If it exceeds 70 parts by weight, the ink tends to undergo running or stringing at the time of transfer.

As a matter of course, tan δ of the ink layer in the above-described first preferred embodiment ranges from 0.4 to 2.5 as measured at a temperature of from 60° to 100° C.

According to the first preferred embodiment, a clear and highly abrasion-resistant image can be formed on a flat and smooth plastic sheet or film having being subjected to no surface treatment at high sensitivity and at low cost.

In a second preferred embodiment of the present invention, the binder resin comprises an isocyanate adduct of a higher fatty acid polyhydric alcohol ester, preferably having a melt viscosity of 2500 to 50000 cSt, particularly 3000 to 50000 cSt at 100° C. It is still preferred that the binder resin comprises the isocyanate adduct and an ethylene-vinyl acetate copolymer, particularly the isocyanate adduct having a melt viscosity of 2500 to 50000 cSt, particularly 3000 to 50000 cSt at 100° C. and the ethylene-vinyl acetate copolymer having a melt flow rate (MFR) of 5 to 2000 dg/min. According to the second preferred embodiment, a negative image can be printed directly on a flat, smooth, and transparent material by a hot-melt thermal transfer system to provide a particularly excellent negative mask for image formation.

The isocyanate adduct of a higher fatty acid polyhydric alcohol ester preferably has a melt viscosity of 2500 to 50000 cSt, more preferably 3000 to 50000 cSt, still preferably 4000 to 7000 cSt, at 100° C. If the melt viscosity at 100° C. is lower than 2500 cSt, the ink layer has strong cohesive force like waxes and tends to fail to form a uniform transferred image. If it exceeds 50000 cSt, the ink tends to become stringy only to provide a transfer image of poor resolving power.

The isocyanate adduct of a higher fatty acid polyhydric alcohol ester is obtained by addition reaction of an isocyanate compound to an ester of a higher fatty acid and a polyhydric alcohol. The isocyanate adduct of a higher fatty acid polyhydric alcohol ester may be used either singly or as a combination of two or more kinds thereof.

The higher fatty acids include saturated fatty acids, unsaturated fatty acids, alicyclic fatty acids, oxygen-containing fatty acids, and hydroxy-fatty acids. These fatty acids preferably contain 2 to 60 carbon atoms, still preferably 5 to 50 carbon atoms, most preferably 10 to 40 carbon atoms. Fatty acids having a melting point of 20° C. or less and containing 10 to 40 carbon atoms are particularly suitable. Examples of suitable fatty acids include saturated fatty acids, such as capric acid, undecylic acid, lauric acid, tridecylic acid, myristic acid, pentadecylic acid, palmitic acid, heptadecylic acid, stearic acid, nonadecanoic acid, arachic acid, behenic acid, lignoceric acid, cerotic acid, heptacosanoic acid, montanic acid, melissic acid, and lacceric acid; unsaturated fatty acids, such as acrylic acid, crotonic acid, isocrotonic acid, caproleic acid, undecylenic acid, oleic acid, elaidic acid, cetoleic acid, erucic acid, brassidic acid, sorbic acid, linoleic acid, linolenic acid, arachidonic acid, docosahexaenoic acid, clupanodonic acid, propiolic acid, and stearolic acid; branched fatty acids such as isovaleric acid; alicyclic fatty acids, such as margaric acid, sterculic acid, hydnocarpic acid, chauloogric acid, and gorlic acid; oxygen-containing fatty acids, such as sabinic acid, ipurolic acid, jalapinolic acid, juniperic acid, ricinoleic acid, and cerebronic acid; and hydroxy-fatty acids such as 12-hydroxystearic acid. It is most effective to use lanolin fatty acids obtained by saponification of hydrous lanolin secreted from sebaceous glands of sheep. These fatty acids may be used either individually or as a combination of two or more thereof.

The polyhydric alcohols include saturated aliphatic polyols, unsaturated aliphatic polyols, alicyclic polyols, and oxygen-containing aliphatic polyols. The polyols preferably contains 1 to 50 carbon atoms, still preferably 1 to 20 carbon atoms, and particularly 1 to 10 carbon atoms. Examples of suitable polyols are ethylene glycol, diethylene glycol, triethylene glycol, tetraethylene glycol, polyethylene glycol, propylene glycol, dipropylene glycol, polypropylene glycol, trimethylene glycol, butanediol, pentanediol, hexylene diol, octylene diol, glycerin, trimethylolpropane, pentaerythritol, dipentaerythritol, 1,3-butylene glycol, monoallyl glycerin, [4-(hydroxyethoxy)phenol]propane, sorbitol, sorbitan, neopentyl glycol, trishydroxyethyl isocyanurate, bisphenol, hydrogenated bisphenol, bisphenol glycol ether, and various epoxy-containing compounds (e.g., triglycidyl isocyanurate). These polyhydric alcohols may be used either individually or as a combination of two or more thereof.

The isocyanate compound which can be used in the present invention includes monoisocyanates, such as methyl isocyanate, ethyl isocyanate, n-propyl isocyanate, n-butyl isocyanate, octadecyl isocyanate, and polymethylene polyphenyl isocyanate; diisocyanates, such as 2,4-trilene diisocyanate, 4,4'-diphenylmethane diisocyanate, dianisidine diisocyanate, m-xylylene diisocyanate, 1,5-naphthalene diisocyanate, transvinylene diisocyanate, N,N'(4,4'-dimethyl-3,3'-diphenyldiisocyanate)uredione, and 2,6-diisocyanate methylcaproate; and triisocyanates, such as triphenylmethane triisocyanate, tris(4-phenylisocyanate)thiophosphate, and 4,4',4"-trimethyl-3,3',3"-triisocyanate-2,4,6-triphenyl cyanurate. Preferred of them are diisocyanates and triisocyanates, and aromatic isocyanate compounds are particularly preferred. These isocyanate compounds may be used either individually or as a combination of two or more thereof.

The ester reaction between the higher fatty acid and the polyhydric alcohol can be carried out by any of known methods. The degree of esterification is not particularly limited. The addition reaction of the isocyanate compound to the resulting higher fatty acid polyhydric alcohol ester can be performed in a conventional manner. While not limited, the number of moles added of the isocyanate compound is preferably about 0.1 to 5 moles based on mole of the ester. Commercially available isocyanate adducts may be used as the isocyanate adduct. For example, urethane-modified lanolin resins Ranox FP-1410N, FPK-410, etc. produced by Yoshikawa Seiyu K.K. can be used.

The isocyanate adduct is preferably used in an amount of 10 to 90 parts by weight, still preferably 20 to 80 parts by weight, based on 100 parts by weight of the ink layer. If the amount of the isocyanate adduct is less than 10 parts by weight, the ink layer tends to exhibit poor release from the substrate. If it exceeds 90 parts by weight, the ink layer tends to have poor adhesion to a plastic image-receiving element.

The ethylene-vinyl acetate copolymer to be used in combination with the isocyanate adduct preferably has an MFR of 5 to 2000 dg/min, still preferably 5 to 1000 dg/min. If the MFR of the ethylene-vinyl acetate copolymer is less than 5 dg/min, the transferred image tends to have poor abrasion resistance. If it exceeds 2000 dg/min, the ink tends to run, failing to conduct thermal transfer recording uniformly.

While not limited, the vinyl acetate content in the ethylene-vinyl acetate copolymer is preferably 15 to 45% by weight. Specific examples of the ethylenevinyl acetate copolymer are EVAFLEX-40Y (vinyl acetate content: 40 wt %; MFR: 65 dg/min), EVAFLEX-EV260 (vinyl acetate content: 28 wt%; MFR: 5 dg/min), EVAFLEX-EV220 (vinyl acetate content: 28 wt %; MFR: 150 dg/min), and EVAFLEX-EV205 (vinyl acetate content: 28 wt %: MFR: 800 dg/min), all produced by Du Pont-Mitsui Polychemicals Co., Ltd.). These ethylene-vinyl acetate copolymers may be used either individually or as a combination of two or more thereof.

The ethylene-vinyl acetate copolymer is preferably used in an amount of 10 to 90 parts by weight, still preferably 25 to 70 parts by weight, most preferably 40 to 65 parts by weight, based on 100 parts by. weight of the ink layer. If the amount of the ethylene-vinyl acetate copolymer is less than 10 parts by weight, the ink layer tends to stain the background of the transferred image. If it exceeds 90 parts by weight, the transferred image tends to have poor abrasion resistance, and the recording medium tends to have reduced sensitivity, which may lead to a reduction in resolving power on high-speed printing.

If desired, the ink layer of the second preferred embodiment may contain other binder resins in addition of the isocyanate adduct and the ethylenevinyl acetate copolymer. Binder resins which may be used in combination include homo- or copolymers of styrene, derivatives and substitutes thereof, such as styrene, vinyltoluene, α-methylstyrene, chlorostyrene, vinylbenzoic acid, sodium vinylbenzenesulfonate, and aminostyrene. In addition, homopolymers of methacrylic acid or esters thereof, such as methyl methacrylate, ethyl methacrylate, butyl methacrylate, and hydroxymethacrylate; acrylic acid or esters thereof, such as methyl acrylate and 2-ethylhexyl acrylate; dienes, such as butadiene and isoprene; and other vinyl monomers, such as acrylonitrile, vinyl ethers, maleic acid, maleic esters, maleic anhydride, cinnamic acid, and vinyl chloride; and copolymers of these monomers and other comonomers may also be used. These vinyl polymers may be used as crosslinked by using a polyfunctional monomer, such as divinylbenzene. Further, polycarbonates, polyesters, silicone resins, fluorine-containing resins, phenolic resins, terpene resins, petroleum resins, hydrogenated petroleum resins, alkyd resins, ketone resins, and cellulose derivatives may also be used as binder resins. Where these polymers or oligomers are used in the form of copolymers, the mode of copolymerization is appropriately selected according to the end use from among alternating copolymers, block copolymers, interpenetrating copolymers, as well as random copolymers. Where two or more polymers or oligomers are used in combination, they may be mixed through mechanical blending by melt blending, solution mixing and emulsion mixing, or a polymer or oligomer component may be polymerized in the presence of another polymer, or they may be blended through multistage polymerization.

The above-mentioned other binder resins may be used in an amount of 10 to 90 parts by weight, preferably 20 to 80 parts by weight, based on 100 parts by weight of the isocyanate adduct or based on 100 parts by weight of the total amount of the isocyanate adduct and the ethylene-vinyl acetate copolymer.

As a matter of course, the ink layer in the above-described second preferred embodiment has tan δ of 0.4 to 2.5 as measured at a temperature of from 60° to 100° C.

In the second preferred embodiment, the first and second binder resins used in the first preferred embodiment may also be used in addition to the isocyanate adduct and the ethylene-vinyl acetate copolymer.

According to the second preferred embodiment, a clear and highly abrasion-resistant image can be formed on a flat and smooth plastic film having being subjected to no surface treatment at high sensitivity and at low cost.

In a third preferred embodiment of the present invention, the binder resin comprises a polyether resin having a bisphenol skeleton with a hydroxyl end group and having a molecular weight of 20000 or less. According to this embodiment using a specific binder resin, a flat, smooth, and transparent image-receiving element can directly be printed to prepare a particularly excellent negative mask for image formation.

The term "molecular weight" as used for the polyether resin means a number average molecular weight as measured by gel-permeation chromatography (GPC) with polystyrene standard. The molecular weight of the polyether resin to be used in this embodiment is 20000 or less, preferably 10000 or less, still preferably 300 to 5000. If it exceeds 20000, the intermolecular cohesive force ascribed to entanglement of molecular chains becomes strong, tending to reduce the resolving power of a transferred image.

The polyether resins include those which are obtained by addition polymerization of a diol compound, such as a bisphenol compound represented by formulae (I) to (IV) shown below or a propylene oxide adduct thereof or an ethylene oxide adduct thereof, and an aliphatic, alicyclic or aromatic epoxy compound having two epoxy groups per molecule and which has a hydroxyl end group.

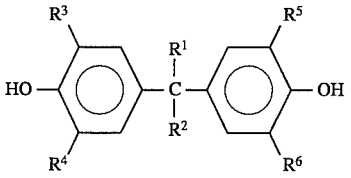

(I)

wherein $R^1$ and $R^2$ each represent a hydrogen atom, an alkyl group or a phenyl group; and $R^3$, $R^4$, $R^5$, and $R^6$ each represent a hydrogen atom, an alkyl group or a halogen atom.

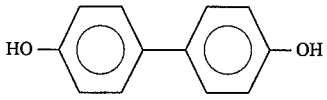

(II)

-continued

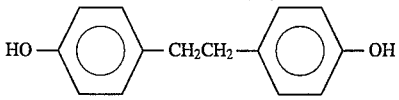

(III)

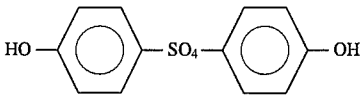

(IV)

The aliphatic epoxy compound having two epoxy groups per molecule includes 1,6-n-hexane diepoxide. The alicyclic epoxy compound having two epoxy groups per molecule includes 1,4-cyclohexyl diepoxide. The aromatic epoxy compound having two epoxy groups per molecule includes bisphenol A diepoxide.

The polyether resins also include those which are obtained by addition polymerization of a bisphenol type epoxy resin and a compound having two hydroxyl groups per molecule, a compound having a hydroxyl group and an amino group per molecule or a compound having a hydroxyl group and a carbonyl group per molecule and which has a hydroxyl end group. The bisphenol type epoxy resin includes a reaction product between an ethylene oxide adduct of bisphenol A and an epoxy compound having two epoxy groups per molecule. The compound having two hydroxyl groups per molecule includes bisphenol A. The compound having a hydroxyl group and an amino group per molecule includes ethanolamine. The compound having a hydroxyl group and a carbonyl group per molecule includes an ester compound between bisphenol A and a fatty acid.

Polyether resins having a branched or crosslinked structure may also be used, which are prepared by carrying out the above-mentioned addition polymerization by additionally using an epoxy compound having three or more epoxy groups per molecule, such as an adduct between 1,2,4-benzenetriol and a fatty acid epoxy compound having two epoxy groups per molecule.

The polyether resin is preferably used in an amount of 10 to 90 parts by weight based on 100 parts by weight of the ink layer.

If desired, the polyether resin may be used in combination with other binder resins, such as ethylenevinyl acetate copolymers, polystyrene resins, vinyl chloride-vinyl acetate copolymers, ethylene-acrylate copolymers, polyester resins, and polyamide resins. The other binder resins are preferably used in a proportion of 10 to 90 parts by weight, still preferably 20 to 80 parts by weight, based on 100 parts by weight of the polyether resin.

As a matter of course, the ink layer in the above-described third preferred embodiment has tan δ of 0.4 to 2.5 as measured at a temperature of from 60° to 100° C.

In the third preferred embodiment, the binder resins used in the first preferred embodiment and/or the binder resins used in the second preferred embodiments may also be used in addition to the polyether resin.

According to the third preferred embodiment, a clear and highly abrasion-resistant image can be formed on a flat and smooth plastic film having being subjected to no surface treatment at high sensitivity and at low cost.

The colorant which can be incorporated into the ink layer includes general organic or inorganic pigments and dyes. Examples of suitable colorants include black dyes and pigments, such as carbon black, oil black, and graphite; acetoacetic arylamide type monoazo yellow pigments (Fast Yellow), such as C.I. Pigment Yellow 1, 3, 74, 97 and 98; acetoacetic arylamide type bisazo yellow pigments, such as C.I. Pigment Yellow 12, 13 and 14; yellow dyes, such as C.I. Solvent Yellow 19, 77 and 79 and C.I. Disperse Yellow 164;

red pigments, such as C.I. Pigment Red 8, 49:1, 53:1, 57:1, 81, 122 and 5; red dyes, such as C.I. Solvent Red 52, 58 and 8; and copper phthalocyanine, derivatives thereof, and modified compounds thereof, such as C.I. Pigment Blue 15:3. Further, colored or colorless sublimable dyes, conventionally employed printing inks, and other dyes and pigments known for coloring can also be used. Particularly preferred of them is carbon black. These dyes or pigments may be used either individually or as a combination of two or more thereof. The tone may be controlled by mixing an extender pigment or a white pigment. In order to improve dispersibility of the colorant in binder resins, the surface of the colorant may be treated with a surface active agent, a coupling agent (e.g., a silane coupling agent) or a polymeric material, or a polymeric dye or a polymer-grafted pigment may be used. The colorant is usually used in an amount of 10 to 90 parts by weight based on 100 parts by weight of the binder resin.

In a fourth preferred embodiment of the present invention, the colorant comprises 30 to 70 parts by weight of carbon black based on 100 parts by weight of the ink layer. Where the thermal transfer recording medium of the present invention is used for directly printing a negative image on a flat, smooth and transparent image-receiving element to prepare a negative mask for image formation, a particularly excellent mask can be obtained by using carbon black as a colorant in the above-specified proportion. If the amount of the colorant is less than 30 parts by weight, the resulting image tends to have a transmission density lower than 1.5, failing to serve as a mask for image formation. If the amount of the colorant exceeds 70 parts by weight, the ink layer has reduced binding force, and the transferred ink tends to have too low fixability on the transparent material to serve as a mask for image formation. It is still preferable that the colorant comprises 35 to 55 parts by weight of carbon black based on 100 parts by weight of the ink layer.

As a matter of course, the ink layer in the forth preferred embodiment has tan δof 0.4 to 2.5 as measured at a temperature of from 60° to 100° C.

The above-described forth preferred embodiment, in which 30 to 70 parts by weight of carbon black is used based on 100 parts by weight of the ink layer, may be combined with the first preferred embodiment and/or the second preferred embodiment, i.e., use of one or more than one, or all of the binder resins to be used in the first embodiment and/or the second embodiment.

According to the fourth preferred embodiment, a negative image can directly be printed on a flat, smooth and transparent plastic film to provide a high quality negative mask for image formation.

As previously stated, adjustment of the tan δ value of the ink layer can also be made by proper addition of a viscoelasticity modifier such as waxes and tackifiers.

Examples of suitable waxes are rice wax, carnauba wax, paraffin wax, candelilla wax, low-molecular weight polyethylene wax, α-olefin oligomers, montan wax, microcrystalline wax, molasses, and Japan wax, with carnauba wax being preferred.

Examples of suitable tackifiers are rosin, rosin derivatives, terpene resins, petroleum resins, coumarone-indene resins, styrene resins, phenolic resins, and xylene resins.

The viscoelasticity modifier (i.e., waxes or tackifiers) is preferably used in an amount of 5 to 50 parts by weight, still preferably 5 to 30 parts by weight, based on 100 parts by weight of the total amount of binder resins and colorants.

The above-mentioned binder resin, colorant, and, if desired, viscoelasticity modifier are dissolved in a solvent, such as toluene, methyl ethyl ketone or isopropyl alcohol, to prepare an ink composition. The ink composition is applied thin onto a substrate with an applicator such as a wire bar coater or a gravure coater, to form an ink layer. The solids content of the ink composition is preferably 5 to 50% by weight, still preferably 10 to 50% by weight. Application of the ink composition to the substrate may be performed by electrostatic powder coating using spray-dried and pulverized fine powder of the ink composition. After powder coating, the coated layer may be fixed on the substrate by heat application, pressure application and/or solvent treatment.

The ink layer preferably has a thickness of 1.5 to 7.0 μm, still preferably 1.5 to 5.0 μm. Where the thermal transfer recording medium of the present invention is used for directly printing a negative image on a flat, smooth and transparent image-receiving element to prepare a negative mask for image formation, a particularly excellent mask can be obtained by forming the ink layer with the above thickness. If the thickness is less than 1.5 μm, it would be necessary to use an extremely large quantity of a colorant in order to obtain a transmission print density of 1.5. It the thickness exceeds 7.0 μm, the ink layer tends to have poor release from the substrate or the transferred image tends to have a reduced resolving power. It is particularly preferred to form an ink layer comprising 30 to 70 parts by weight of carbon black based on 100 parts by weight of the ink layer and having a thickness of 1.5 to 7.0 μm to thereby provide a thermal transfer recording medium which exhibits improved running properties during printing and gives a transferred image having an increased resolving power and improved strength.

The loss tangent (tan δ) of the ink layer obtained by measuring viscoelasticity is a value obtained by loading an ink film, prepared by applying the aforesaid ink composition on a glass plate and, after removing the solvent by evaporation, stripping the ink layer off the glass plate, on a rheometer Model RDA-2 manufactured by Rheometrics Co.

The substrate on which an ink layer is provided includes paper, such as condenser paper and glassine paper, and films of plastics, such as polyesters (e.g., polyethylene terephthalate), polyimides, polycarbonates, polyamides, polyethylene and polypropylene. The substrate preferably has a thickness of 1 to 20 μm.

While the essential structure of the thermal transfer recording medium of the present invention comprises the above-described substrate provided thereon at least an ink layer, layers other than the ink layer may also be provided. For example, a thermoplastic release layer may be provided between the substrate and the ink layer so as to further improve the release properties of the ink layer and the resolving power. Such a thermoplastic release layer can be formed, for example, by applying a releasing wax in thin film.

The releasing wax includes microcrystalline wax, rice wax, carnauba wax and polyethylene oxide wax. The film strength of the thermoplastic release layer can be increased by adding to the releasing wax 1 to 50 parts by weight of a resin for film strength modification, such as an ethylene-vinyl acetate copolymer, polyethylene, a petroleum resin or an ethylene-acrylate copolymer, based on 100 parts by weight of the releasing wax.

An adhesive layer may also be provided on the ink layer so as to further improve fixability of a transferred image on an image-receiving element. Such an adhesive layer can be formed, for example, by applying polyethylene, an ethylene-vinyl acetate copolymer, an ethylene-acrylate copolymer, an ionomer resin, a polyamide resin, a nylon resin, a polyester resin or a polypropylene resin on the ink layer in thin film.

A back coat layer may be provided on the side of the substrate opposite to the ink layer so as to obtain improved heat resistance of the thermal transfer recording medium. The back coat layer can be formed, for example, by applying a silicone compound, a fluorine compound, a resin or a crosslinked polymer onto the substrate.

The thermal transfer recording medium according to the present invention is especially suitable for use in the preparation of a negative mask for image formation. A negative mask for image formation can be obtained by superposing the thermal transfer recording medium of the present invention on a flat and smooth image-receiving element, such as a plastic film, with the ink layer thereof contacting with the image-receiving element and imagewise melting the ink layer by the action of heat from the side of the substrate to thereby form a transferred image on the image-receiving element. The negative mask for image formation includes an original mask for photographically printing letters, a mask for printing plate making, and the like.

The flat and smooth image-receiving element includes plastic sheets, such as commercially available OHP sheets made of polyethylene terephthalate, polyvinyl chloride films, polycarbonate films, cellophane paper and celluloid films; resin-laminated paper; and metal-deposited films.

The thermal transfer recording medium of the present invention can be used for preparation of not only negative masks for image formation but originals for OHP decorative films and labels. Since the thermal transfer recording medium of the present invention provides a clear image on a flat and smooth plastic film at high sensitivity, the original for OHP prepared by using the thermal transfer recording medium of the present invention has a particularly high contrast. Further, the present invention makes it possible to form an image of high print quality on a variety of image-receiving elements, such as wrapping films, photographs, resin-laminated paper, metal-deposited films as well as paper.

As has been described above, the thermal transfer recording medium of the present invention enables thermal transfer recording on a flat and smooth image-receiving element such as a plastic sheet even having being subjected to no special surface treatment to form a clear image at high sensitivity.

Further, a negative mask for high quality image formation can be produced by thermal transfer recording using the thermal transfer recording medium of the present invention.

The present invention will now be illustrated in greater detail with reference to Examples, but it should be understood that the present invention is not construed as being limited thereto. Unless otherwise indicated, all the parts are by weight.

In each thermal transfer recording medium prepared in Examples and Comparative Examples, the ink layer consists of the solids content of the respective ink composition as a result of evaporation of the solvent used.

EXAMPLE 1

In toluene were dispersed 95 parts of rice wax as a releasing wax and 5 parts of an ethylene-vinyl acetate copolymer as a film strength modifier by means of a ball mill to prepare a coating composition for a thermoplastic release layer. The composition was applied to a 3.5 μm thick polyethylene terephthalate (PET) sheet having a silicone back coat layer with a wire bar coater to form a thermoplastic release layer.

The following formulation were dispersed for 20 hours in a ball mill to prepare an ink composition. The ink composition was applied to the thermoplastic release layer with a wire bar coater to a thickness of 2.5 μm to prepare a thermal transfer recording medium.

| | |
|---|---|
| Carbon black (colorant) | 4 parts |
| Ethylene-vinyl acetate copolymer (binder resin) | 3 parts |
| Urethane-modified lanolin resin (binder resin) | 3 parts |
| Toluene (solvent) | 40 parts |

Separately, the ink composition was applied to a glass plate, dried and peeled. The viscoelasticity characteristics of the resulting ink film were measured with a rheometer Model RDA-2, manufactured by Rheometrics Co. The maximum and the minimum of the loss tangent (tan δ) as obtained by measurement at a temperature of from 60°× up to 100° C. are shown in Table 1 below.

The above obtained thermal transfer recording medium was set on a commercially available word processor Model 30LX601, manufactured by Fujitsu Ltd., and a 100 μm thick PET sheet was printed to prepare a negative mask for image formation. The running properties of the recording medium on the word processor and the print quality of the resulting negative mask were evaluated. The results obtained are shown in Table 2 below.

The transmission density of the image on the resulting negative mask was found to be 2.5 as measured with a transmission densitometer TD-904, manufactured by Macbeth Co. The negative mask was actually used for printing a positive image on a commercially available photographic paper. After development, the quality of the print was evaluated. As a result, the print had satisfactory quality with no fog.

EXAMPLE 2

An ink composition was prepared by dispersing the following formulation components for 20 hours in a ball mill.

| | |
|---|---|
| Carbon black (colorant) | 4 parts |
| Ethylene-vinyl acetate copolymer (binder resin) | 4 parts |
| Polyether resin (binder resin) | 2 parts |
| Carnauba wax (wax) | 1 part |
| Methyl ethyl ketone (solvent) | 40 parts |

A thermal transfer recording medium was prepared in the same manner as in Example 1, except for using the above prepared ink composition. Viscoelasticity measurement and evaluation were made in the same manner as in Example 1. The results obtained are shown in Tables 1 and 2.

EXAMPLE 3

An ink composition was prepared by dispersing the following formulation components for 20 hours in a ball mill.

| | |
|---|---|
| Carbon black (colorant) | 4 parts |
| Ethylene-vinyl acetate copolymer (binder resin) | 3 parts |
| Polyether resin (binder resin) | 3 parts |
| Methyl ethyl ketone (solvent) | 40 parts |

A thermal transfer recording medium was prepared in the same manner as in Example 1, except for using the above prepared ink composition. Viscoelasticity measurement and evaluation were made in the same manner as in Example 1. The results obtained are shown in Tables 1 and 2.

Comparative Example 1

An ink composition was prepared by dispersing the following formulation components for 20 hours in a ball mill.

| | |
|---|---|
| Carbon black (colorant) | 4 parts |
| Ethylene-vinyl acetate copolymer (binder resin) | 2 parts |
| Carnauba wax (wax) | 4 parts |
| Methyl ethyl ketone (solvent) | 40 parts |

A thermal transfer recording medium was prepared in the same manner as in Example 1, except for using the above prepared ink composition. Viscoelasticity measurement and evaluation were made in the same manner as in Example 1. The results obtained are shown in Tables 1 and 2.

Comparative Example 2

An ink composition was prepared by dispersing the following formulation components for 20 hours in a ball mill.

| | |
|---|---|
| Carbon black (colorant) | 4 parts |
| Ethylene-vinyl acetate copolymer (binder) | 5 parts |
| Carnauba wax (wax) | 1 part |
| Toluene (solvent) | 40 parts |

A thermal transfer recording medium was prepared in the same manner as in Example 1, except for using the above prepared ink composition. Viscoelasticity measurement and evaluation were made in the same manner as in Example 1. The results obtained are shown in Tables 1 and 2.

TABLE 1

| | Loss Tangent (tan δ) | |
|---|---|---|
| Example No. | Maximum | Minimum |
| Example 1 | 1.2 | 0.5 |
| Example 2 | 1.5 | 1.0 |
| Example 3 | 2.1 | 1.0 |
| Comparative Example 1 | 3.0 | 0.5 |
| Comparative Example 2 | 0.7 | 0.3 |

TABLE 2

| Example No. | Running Properties | Print Quality |
|---|---|---|
| Example 1 | good | good |
| Example 2 | good | good |
| Example 3 | good | good |
| Comparative Example 1 | good | plugging of letters |
| Comparative Example 2 | poor release | occurrence of unprinted portions |

As is shown in Tables 1 and 2, the thermal transfer recording media of Examples 1 to 3, in which the ink layer has tan δ ranging from 0.4 to 2.5, each provided a clear image at high sensitivity, whereas those of Comparative Examples 1 and 2, in which the tan 67 of the ink layer is out of the above range, failed to provide a clear image, suffering from reduction in print quality due to plugging of letters (Comparative Example 1) or reduction in running properties due to poor releasability of the ink layer from the substrate and reduction in print quality due to occurrence of unprinted portions in letters (Comparative Example 2).

It is seen in particular that the thermal transfer recording media using a combination of the first and second binders (Examples 1 to 3) form a clear image at high sensitivity.

Thus, the thermal transfer recording medium of the present invention enables clear transfer recording on a PET sheet at low cost.

EXAMPLE 4

An ink composition was prepared by dispersing the following formulation components for 20 hours in a ball mill.

| | |
|---|---|
| Carbon black (colorant) | 3 parts |
| Ethylene-vinyl acetate copolymer (binder resin) | 3.5 parts |
| Urethane-modified lanolin resin (binder resin) | 3.5 parts |
| Toluene (solvent) | 40 parts |

A thermal transfer recording medium was prepared in the same manner as in Example 1, except for using the above prepared ink composition and changing the thickness of the ink layer to 5 μm. Measurement of viscoelasticity characteristics, evaluation of running properties, print quality on a PET sheet, measurement of transmission density of the image on a PET sheet and evaluation of print quality on photographic paper were conducted in the same manner as in Example 1. The results obtained are shown in Tables 3 and 4.

EXAMPLE 5

An ink composition was prepared by dispersing the following formulation components for 20 hours in a ball mill.

| | |
|---|---|
| Carbon black (colorant) | 3.5 parts |
| Ethylene-vinyl acetate copolymer (binder resin) | 4 parts |
| Polyether resin (binder resin) | 2.5 parts |
| Carnauba wax (wax) | 1 part |
| Methyl ethyl ketone (solvent) | 40 parts |

A thermal transfer recording medium was prepared in the same manner as in Example 1, except for using the above prepared ink composition and changing the thickness of the ink layer to 4 μm. Measurement and evaluation were conducted in the same manner as in Example 4. The results obtained are shown in Tables 3 and 4.

EXAMPLE 6

An ink composition was prepared by dispersing the following formulation components for 20 hours in a ball mill.

| | |
|---|---|
| Carbon black (colorant) | 5.5 parts |
| Ethylene-vinyl acetate copolymer (binder resin) | 2 parts |
| Carnauba wax (wax) | 2.5 parts |
| Toluene (solvent) | 40 parts |

A thermal transfer recording medium was prepared in the same manner as in Example 1, except for using the above prepared ink composition and changing the thickness of the ink layer to 1.5 μm. Measurement and evaluation were conducted in the same manner as in Example 4. The results obtained are shown in Tables 3 and 4.

Comparative Example 3

An ink composition was prepared by dispersing the following formulation components for 20 hours in a ball mill.

| | |
|---|---|
| Carbon black (colorant) | 2.5 parts |
| Ethylene-vinyl acetate copolymer (binder resin) | 3 parts |
| Carnauba wax (wax) | 4.5 parts |
| Toluene (solvent) | 40 parts |

A thermal transfer recording medium was prepared in the same manner as in Example 1, except for using the above prepared ink composition and changing the thickness of the ink layer to 5.0 μm. Measurement and evaluation were conducted in the same manner as in Example 4. The results obtained are shown in Tables 3 and 4.

Comparative Example 4

An ink composition was prepared by dispersing the following formulation components for 20 hours in a ball mill.

| | |
|---|---|
| Carbon black (colorant) | 7.5 parts |
| Ethylene-vinyl acetate copolymer (binder resin) | 1.5 parts |
| Carnauba wax (wax) | 1 part |
| Toluene (solvent) | 40 parts |

A thermal transfer recording medium was prepared in the same manner as in Example 1, except for using the above prepared ink composition and changing the thickness of the ink layer to 7.5 μm. Measurement and evaluation were conducted in the same manner as in Example 4. The results obtained are shown in Tables 3 and 4.

Comparative Example 5

An ink composition was prepared by dispersing the following formulation components for 20 hours in a ball mill.

| | |
|---|---|
| Carbon black (colorant) | 7.5 parts |
| Ethylene-vinyl acetate copolymer (binder resin) | 1.5 parts |
| Carnauba wax (wax) | 1 part |
| Toluene (solvent) | 40 parts |

A thermal transfer recording medium was prepared in the same manner as in Example 1, except for using the above prepared ink composition and changing the thickness of the ink layer to 1.5 μm. Measurement and evaluation were conducted in the same manner as in Example 4. The results obtained are shown in Tables 3 and 4.

TABLE 3

| Example No. | Loss Tangent (tan δ) Maximum | Minimum | Running Properties | Print Quality on PET Sheet |
|---|---|---|---|---|
| Example 4 | 1.5 | 0.7 | good | good |
| Example 5 | 1.7 | 1.2 | good | good |
| Example 6 | 2.1 | 1.0 | good | good |
| Compara. Example 3 | 3.2 | 1.5 | poor release | good |
| Compara. Example 4 | 2.8 | 1.0 | good | plugging of letters |
| Compara. Example 5 | 2.8 | 1.0 | good | partial dis-appearance or letters |

TABLE 4

| Example No. | Transmis-sion Print Density | Print Quality on Photogra-phic Paper | Fog |
|---|---|---|---|
| Example 4 | 2.0 | good | not observed |
| Example 5 | 3.5 | good | not observed |
| Example 6 | 4.3 | good | not observed |
| Compara. Example 3 | 1.2 | good | observed |
| Compara. Example 4 | 4.7 | plugging of letters | not observed |
| Compara. Example 5 | 3.5 | occurrence of unprinted portions, peel of printed area | not observed |

As can be seen from Table 4, a negative mask for image formation having a transmission image density of 1.5 or higher can be prepared by using the transfer recording media of Examples 4 to 6. A printed positive image obtained by using the resulting negative mask has high quality with no fog on the background, no image defect such as plugging or occurrence of unprinted portions in letters, or no peel of the printed area. To the contrary, the mask obtained by using the recording medium of Comparative Example 3 has a transmission image density of less than 1.5. Although the mask obtained by using the recording medium of Comparative Example 4 or 5 has a transmission image density exceeding 1.5, the resulting print suffered from plugging or occurrence of unprinted portions in letters or peel of the printed area.

Thus, a negative mask having a high quality negative image for image formation can easily be prepared simply by printing a negative image directly on a PET sheet by using any of the thermal transfer recording media of Examples 4 to 6.

EXAMPLE 7

An ink composition was prepared by dispersing the following formulation components for 20 hours in a ball mill.

| | |
|---|---|
| Carbon black (colorant) | 4 parts |
| Ethylene-vinyl acetate copolymer EVAFLEX-EV260 (MFR: 5 dg/min) | 3 parts |
| Isocyanate adduct of lanolin fatty acid polyhydric alcohol ester (melt viscosity: 5000 cSt) | 3 parts |
| Toluene (solvent) | 40 parts |

A thermal transfer recording medium was prepared in the same manner as in Example 1, except for using the above prepared ink composition and changing the thickness of the ink layer to 3 μm.

Measurement and evaluation were conducted in the same manner as in Example 1. The results obtained are shown in Table 5. Further, the transferred image on the resulting negative mask was evaluated with the naked eye, and the abrasion resistance of the transferred image was evaluated with a print fastness testing machine. The results obtained are shown in Table 6.

EXAMPLE 8

An ink composition was prepared by dispersing the following formulation components for 20 hours in a ball mill.

| | |
|---|---|
| Carbon black (colorant) | 4 parts |
| Ethylene-vinyl acetate copolymer EVAFLEX-EV220 (MFR: 150 dg/min) | 3 parts |
| Isocyanate adduct of lanolin fatty acid polyhydric alcohol ester (melt viscosity: 5000 cSt) | 3 parts |
| Toluene (solvent) | 40 parts |

A thermal transfer recording medium was prepared in the same manner as in Example 1, except for using the above prepared ink composition and changing the thickness of the ink layer to 3 μm. Measurement and evaluation were conducted in the same manner as in Example 1. The results obtained are shown in Table 5. Further, the transferred image on the resulting negative mask was evaluated with the naked eye, and the abrasion resistance of the transferred image was evaluated with a print fastness testing machine. The results obtained are shown in Table 6.

EXAMPLE 9

An ink composition was prepared by dispersing the following formulation components for 20 hours in a ball mill.

| | |
|---|---|
| Carbon black (colorant) | 4 parts |
| Ethylene-vinyl acetate copolymer EVAFLEX-EV205 (MFR: 800 dg/min) | 3 parts |
| Isocyanate adduct of lanolin fatty acid polyhydric alcohol ester (melt viscosity: 5000 cSt) | 3 parts |
| Toluene (solvent) | 40 parts |

A thermal transfer recording medium was prepared in the same manner as in Example 1, except for using the above prepared ink composition and changing the thickness of the ink layer to 3 μm. Measurement and evaluation were conducted in the same manner as in Example 1. The results obtained are shown in Table 5. Further, the transferred image on the resulting negative mask was evaluated with the naked eye, and the abrasion resistance of the transferred image was evaluated with a print fastness testing machine. The results obtained are shown in Table 6.

EXAMPLE 10

An ink composition was prepared by dispersing the following formulation components for 20 hours in a ball mill.

| | |
|---|---|
| Carbon black (colorant) | 4 parts |
| Ethylene-vinyl acetate copolymer EVAFLEX-EV205 (MFR: 800 dg/min) | 1.5 parts |
| Isocyanate adduct of lanolin fatty acid polyhydric alcohol ester (melt viscosity: 5000 cSt) | 4.5 parts |
| Toluene (solvent) | 40 parts |

A thermal transfer recording medium was prepared in the same manner as in Example 1, except for using the above prepared ink composition and changing the thickness of the ink layer to 3 μm. Measurement and evaluation were conducted in the same manner as in Example 1. The results obtained are shown in Table 5. Further, the transferred image on the resulting negative mask was evaluated with the naked eye, and the abrasion resistance of the transferred image was evaluated with a print fastness testing machine. The results obtained are shown in Table 6.

TABLE 5

| Example No. | Loss Tangent (tan δ) Maximum | Minimum | Running Properties | Print Quality |
|---|---|---|---|---|
| Example 7 | 0.8 | 0.4 | good | good |
| Example 8 | 1.1 | 0.5 | good | good |
| Example 9 | 1.7 | 1.0 | good | good |
| Example 10 | 1.5 | 0.6 | good | good |

TABLE 6

| Example No. | Image Quality | Abrasion Resistance | Background Stains |
|---|---|---|---|
| Example 7 | good | slightly good | good |
| Example 8 | good | good | good |
| Example 9 | good | good | good |
| Example 10 | good | good | good |

As shown in Table 6, it was confirmed that the masks obtained by using the thermal transfer recording media of Examples 7 to 10, in which the binder of the ink layer comprises an isocyanate adduct having a melt viscosity of 2500 to 50000 cSt at 100° C. and an ethylene-vinyl acetate copolymer having an MFR of 5 to 2000 dg/min, each has a clear and highly abrasion-resistant transferred image with no background stains.

Thus, the thermal transfer recording media of Examples 7 to 10 each enables thermal transfer recording on a PET film to provide a clear and abrasion-resistant image at low cost.

EXAMPLE 11

In toluene were dispersed 90 parts of microcrystalline wax as a releasing wax and 10 parts of an ethylene-vinyl acetate copolymer as a film strength modifier for 20 hours by means of a ball mill to prepare a coating composition for a thermoplastic release layer. The composition was applied to a 3.5 μm PET sheet having a silicone back coat layer with a wire bar coater to form a thermoplastic release layer having a thickness of 1 μm.

The following formulation components were dispersed for 20 hours in a ball mill to prepare an ink composition. The ink composition was applied to the thermoplastic release layer with a wire bar coater to prepare a thermal transfer recording medium having a 2 μm thick ink layer.

| | |
|---|---|
| Carbon black (colorant) | 4 parts |
| Polyether resin (binder resin; molecular weight: 600) | 4 parts |
| Ethylene-vinyl acetate copolymer (binder resin) | 2 parts |
| Toluene (solvent) | 40 parts |

Measurement and evaluation were conducted in the same manner as in Example 1. The results obtained are shown in Table 7. Further, the transferred image on the resulting negative mask was evaluated with the naked eye, and the abrasion resistance of the transferred image was evaluated with a print fastness testing machine. The results obtained are shown in Table 8.

EXAMPLE 12

An ink composition was prepared by dispersing the following formulation components for 20 hours in a ball mill.

| | |
|---|---|
| Carbon black (colorant) | 4 parts |
| Polyether resin (binder resin; molecular weight: 2000) | 4 parts |
| Ethylene-vinyl acetate copolymer (binder resin) | 2 parts |
| Toluene (solvent) | 40 parts |

A thermal transfer recording medium was prepared in the same manner as in Example 11, except for using the above prepared ink composition. Measurement and evaluation were conducted in the same manner as in Example 11. The results obtained are shown in Tables 7 and 8.

EXAMPLE 13

An ink composition was prepared by dispersing the following formulation components for 20 hours in a ball mill.

| | |
|---|---|
| Carbon black (colorant) | 4 parts |
| Polyether resin (binder resin; molecular weight: 5000) | 4 parts |
| Ethylene-vinyl acetate copolymer (binder resin) | 2 parts |
| Toluene (solvent) | 40 parts |

A thermal transfer recording medium was prepared in the same manner as in Example 11, except for using the above prepared ink composition. Measurement and evaluation were conducted in the same manner as in Example 11. The results obtained are shown in Tables 7 and 8.

Comparative Example 6

An ink composition was prepared by dispersing the following formulation components for 20 hours in a ball mill.

| | |
|---|---|
| Carbon black (colorant) | 4 parts |
| Paraffin wax (viscoelasticity modifier) | 4 parts |
| Ethylene-vinyl acetate copolymer (binder resin) | 2 parts |
| Toluene (solvent) | 40 parts |

A thermal transfer recording medium was prepared in the same manner as in Example 11, except for using the above prepared ink composition. Measurement and evaluation were conducted in the same manner as in Example 11. The results obtained are shown in Tables 7 and 8.

TABLE 7

| Example No. | Loss Tangent (tan δ) Maximum | Loss Tangent (tan δ) Minimum | Running Properties | Print Quality |
|---|---|---|---|---|
| Example 11 | 1.5 | 1.0 | good | good |
| Example 12 | 2.0 | 1.3 | good | good |
| Example 13 | 2.4 | 1.6 | good | good |
| Compara. Example 6 | 3.0 | 1.5 | good | running of ink |

TABLE 8

| Example No. | Image Quality | Abrasion Resistance | Background Stains |
|---|---|---|---|
| Example 11 | good | slightly good | good |
| Example 12 | good | good | good |
| Example 13 | good | good | good |
| Compara. Example 6 | poor | poor | poor |

As shown in Table 8, it was confirmed that the masks obtained by using the thermal transfer recording media of Examples 11 to 13 each has a clear and highly abrasion-resistant transferred image with no background stains. To the contrary, the mask obtained by using the medium of Comparative Example 6, in which the binder of the ink layer solely consists of a resin having no bisphenol skeleton, suffers from background stains, the transferred image of the mask is unclear, and the abrasion resistance of the image was below the acceptable level.

Thus, the thermal transfer recording media of Examples 11 to 13 enable thermal transfer recording on a PET film to give a clear and highly abrasion-resistant image at low cost.

What is claimed is:

1. A thermal transfer recording medium comprising a substrate provided thereon at least an ink layer which is to be transferred by heat application, characterized in that the loss tangent (tan δ) of said ink layer in viscoelasticity measurement at a temperature of from 60° to 100° C. ranges from 0.4 to 2.5, wherein said ink layer comprises a binder resin and a colorant, and said binder resin comprises an isocyanate adduct of a higher fatty acid polyhydric alcohol ester having a melt viscosity of 2500 to 50000 cSt at 100° C.

2. A thermal transfer recording medium comprising a substrate provided thereon at least an ink layer which is to be transferred by heat application, characterized in that the loss tangent (tan δ) of said ink layer in viscoelasticity measurement at a temperature of from 60° to 100° C. ranges from 0.4 to 2.5, wherein said ink layer comprises a binder resin and a colorant, and said binder resin comprises an isocyanate adduct of a higher fatty acid polyhydric alcohol ester having a melt viscosity of 2500 to 50000 cSt at 100° C. and an ethylene-vinyl acetate copolymer.

3. The thermal transfer recording medium as claimed in claim 1, wherein said ethylene-vinyl acetate copolymer has a melt flow rate of 5 to 2000 dg/min, and said isocyanate adduct is present in an amount of 10 to 90 parts by weight and said ethylene-vinyl acetate is present in an amount of 10 to 90 parts by weight based on 100 parts by weight of said ink layer.

4. The thermal transfer recording medium as claimed in claim 2, wherein said colorant comprises 30 to 70 parts by weight of carbon black based on 100 parts by weight of said ink layer.

5. The thermal transfer recording medium as claimed in claim 2, wherein a thermoplastic release layer is provided between said substrate and said ink layer.

6. The thermal transfer recording medium as claimed in claim 1, wherein said colorant comprises 30 to 70 parts by weight of carbon black based on 100 parts by weight of said ink layer.

7. The thermal transfer recording medium as claimed in claim 1, wherein a thermoplastic release layer is provided between said substrate and said ink layer.

8. A thermal transfer recording medium comprising a substrate provided thereon at least an ink layer which is to be transferred by heat application, characterized in that the loss tangent (tan δ) of said ink layer in viscoelasticity measurement at a temperature of from 60° to 100° C. ranges from 0.4 to 2.5, wherein said ink layer comprises a binder resin and a colorant, and said binder resin comprises a polyether resin having a bisphenol skeleton with a hydroxyl end group and having a molecular weight of 20000 or less.

9. The thermal transfer recording medium as claimed in claim 8, wherein said colorant comprises 30 to 70 parts by weight of carbon black based on 100 parts by weight of said ink layer.

10. The thermal transfer recording medium as claimed in claim 8, wherein a thermoplastic release layer is provided between said substrate and said ink layer.

* * * * *